US006371169B1

(12) United States Patent
Berktold

(10) Patent No.: US 6,371,169 B1
(45) Date of Patent: Apr. 16, 2002

(54) METHOD FOR THE OPERATION OF A THREAD SUPPLYING APPARATUS OF A WEAVING MACHINE

(75) Inventor: Klaus Berktold, Rüti (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/645,792

(22) Filed: Aug. 24, 2000

(30) Foreign Application Priority Data

Sep. 27, 1999 (EP) ..... 99810865

(51) Int. Cl.[7] ..... D03D 47/36
(52) U.S. Cl. ..... 139/452
(58) Field of Search ..... 139/452

(56) References Cited

U.S. PATENT DOCUMENTS 5,285,821 A * 2/1994 Fredriksson ..... 139/452

FOREIGN PATENT DOCUMENTS

| | | |
|---|---|---|
| EP | 0195469 A2 | 9/1986 |
| EP | 0261683 A2 | 3/1988 |
| FR | 2556749 | 6/1985 |
| WO | WO 93/23595 | 11/1993 |
| WO | WO 99/14149 | 3/1999 |

* cited by examiner

*Primary Examiner*—Andy Falik
(74) *Attorney, Agent, or Firm*—Townsend and Townsend and Crew LLP

(57) ABSTRACT

A method for the operation of a thread supplying apparatus of a weaving machine. The method include transmitting information about a required weft thread to subsequent weft insertions. The information is transmitted after every complete weaving machine cycle to the thread supplying apparatus and at the same time. Thus, the information about the required weft thread of at least one of the two subsequent weft insertions has already previously been transmitted.

9 Claims, 4 Drawing Sheets

METHOD FOR THE OPERATION OF A THREAD SUPPLYING APPARATUS OF A WEAVING MACHINE

BACKGROUND OF THE INVENTION

1. Field of the Invention

The invention relates to a method for the operation of a thread supplying apparatus of a weaving machine.

2. Description of the Prior Art

An exemplary embodiment of the most common kind of a thread supplying apparatus, which serves for the intermediate storage of a weft thread, is known from the patent specification EP 0 811 573 A2. For inserting a weft thread into a shed which is formed by a weaving machine the weft thread is, as is known, drawn off from a supply bobbin, a specific weft thread length is stored on the intermediate storage of the thread supplying apparatus, and the weft thread is then inserted into the shed with the help of a projectile or a rapier.

In the operation of a thread supplying apparatus of this kind there arises the problem that the draw-off tension of the weft thread which is stored on the intermediate storage depends on the winding speed of a wind-up member, which serves to wind the weft thread onto a storage drum of the thread supplying apparatus. With increasing winding speed the draw-off resistance of the weft thread from the intermediate storage increases. If the weft thread is applied to the storage drum of the thread supplying apparatus with a high winding speed, whether this be caused by a brief rapid winding up of weft threads and/or by a high speed of rotation of the weaving machine with a correspondingly large requirement of weft threads and high winding speed, then this results in a high draw-off resistance of the weft thread and an undesirably high thread tension. Disadvantageous in the operation of known thread supplying apparatuses is thus the fact that high thread tensions can arise in the weft thread, which causes a damage to the weft thread and in particular increases the risk of a weft thread breaking.

SUMMARY OF THE INVENTION

The object of the present invention is to operate the thread supplying apparatuses of a weaving machine in such a manner that the weft thread is exposed to lower stresses.

The object is in particular satisfied by a method for operating a thread supplying apparatus of a weaving machine in that the weft thread requirement for at least two following weft insertions is transmitted to the thread supplying apparatus at the same time. In a preferred method the information for four, five, eight, twelve or, for example, sixteen weft insertions is transmitted at the same time to the thread supplying apparatus. The thread supplying apparatus thereby has available an advance information in that in addition to the weft thread requirement for the next following weft insertion, the information with respect to the weft thread requirement for at least one further, following weft insertion is present. The thread supplying apparatus can be controlled with the help of this advance information in such a manner that, at the time point of the effective weft thread requirement, sufficient weft thread is located on the storage drum, with the thread supplying apparatus or a control device, which is placed before it and which controls the thread supplying apparatus, controlling the speed of rotation of the wind-up member in such a manner that, for example, the maximum speed of rotation of the wind-up member remains as low as possible, and/or that the acceleration or braking of the wind-up member takes place as slowly as possible. A thread supplying apparatus has, as is for example described in the specification WO 99/14149, a control system with a microprocessor, so that in the presence of advance information the thread supplying apparatus automatically winds the thread onto the storage body and determines the speed of rotation, the acceleration or the braking of the wind-up member automatically and, in particular, in such a manner that the weft thread does not experience too great a mechanical stress.

The method in accordance with the invention thus has the advantage that the weft threads are wound onto the storage drum relatively carefully even at a high weft thread requirement, and that the draw-off resistance of the weft thread lies in a tolerable range, through which the danger of weft thread breakages is reduced.

For the operation of a weaving machine a plurality of thread supplying apparatuses is usually required, which are controlled and monitored by the weaving machine control system. In an advantageous arrangement all thread supplying apparatuses are connected to a common data bus, with a common information signal with respect to the weft thread requirement preferably being delivered to all thread supplying apparatuses. At least the information as to when which thread supplying apparatus has to deliver an amount of weft thread is encoded in this common information signal. Thus each thread supplying apparatus is automatically in a position to wind up the respectively required amount of weft thread onto the storage drum prior to the specified time as a result of the advance information which is contained in the common information signal, with the wind-up member being controlled in such an ideal manner that a low stressing of the weft thread results.

In an advantageous method the common information signal is transmitted anew to all thread supplying apparatuses after each complete weaving machine cycle. This method has the advantage that in the event of a failure, or of a putting back into operation of a thread supplying apparatus, the remaining thread supplying apparatuses, which are capable of functioning, are controlled in such a manner that they make the required amount of weft thread available. Thanks to the advance information which is contained in the common information signal, the respective thread supplying apparatuses which are capable of functioning are in a position to control the wind-up member in such an ideal manner that the required greater or lesser amount of weft threads is available on the respective storage drums, with a high weft thread stressing being avoided.

DESCRIPTION OF THE PRIOR ART

DETAILED DESCRIPTION OF SPECIFIC EXEMPLARY EMBODIMENTS

Figure 1:
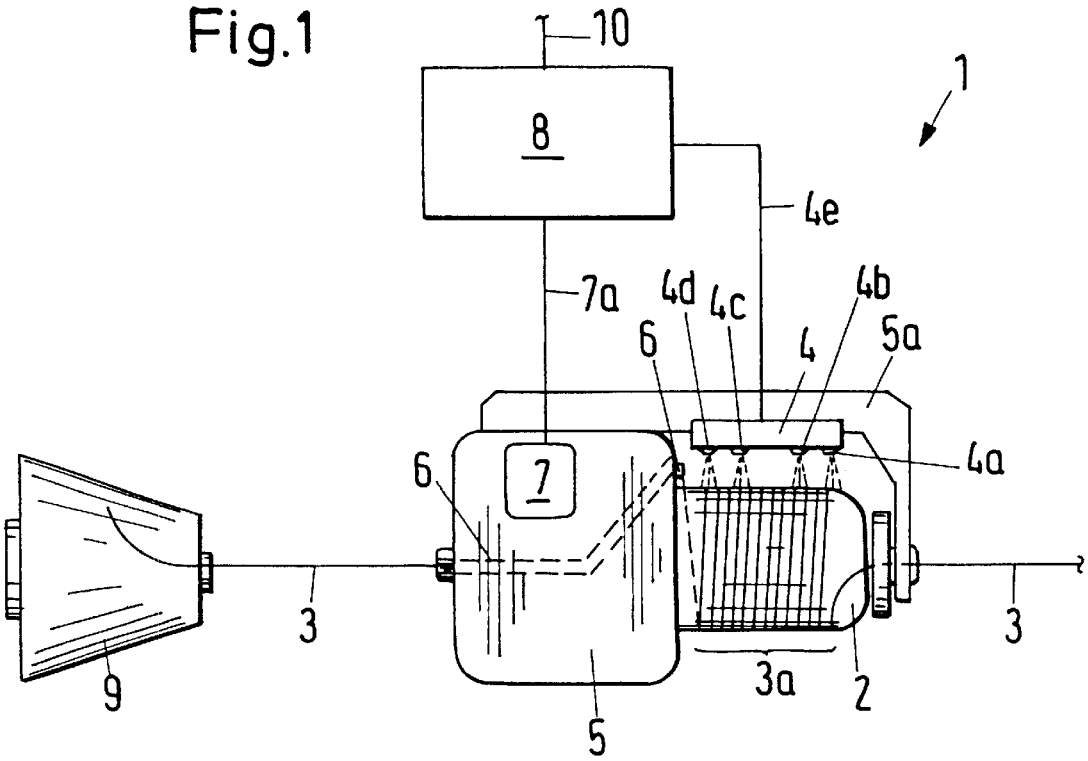
FIG. 1 is a side view of a thread supplying apparatus.

The thread supplying apparatus 1 illustrated in FIG. 1 comprises, among other things, a stationary housing 5, a storage drum 2 which is for example connected via magnetic holding means, and a holding arm 5*a*. A wind-up member 6 which is driven via a drive motor 7 and which is rotatably journalled about the longitudinal axis of the storage drum 2 draws a weft thread 3 from a supply bobbin 9 which is placed before it and winds it around the storage drum 2 so that a stored amount of weft thread 3*a* forms thereupon. The stored amount of weft thread 3*a* is drawn off by insertion members of a weaving machine, such as for example a rapier or a projectile, which are placed after the storage drum 2, and is inserted into an open shed. At least the weft thread requirement necessary for a complete weft insertion is stored on the storage drum 2, with a multiple of the required weft thread length preferably being stored. The weft thread requirement or the required weft thread length necessary for a complete weft insertion is dependent on the cloth width. For a predetermined web width the weft thread requirement for a complete weft insertion thus has a constant value.

A sensor 4 which is arranged at the holding arm 5*a* and which has sensor elements 4*a*, 4*b*, 4*c*, 4*d* monitors the length of the wound-up amount of weft thread 3*a* and transmits the measurement signals via an electrical line 4*e* to a control apparatus 8, which in addition controls the drive motor 7 via an electrical line 7*a*. The control apparatus 8 is connected via a data bus 10 to a higher level weaving machine control apparatus 12.

Figure 2:
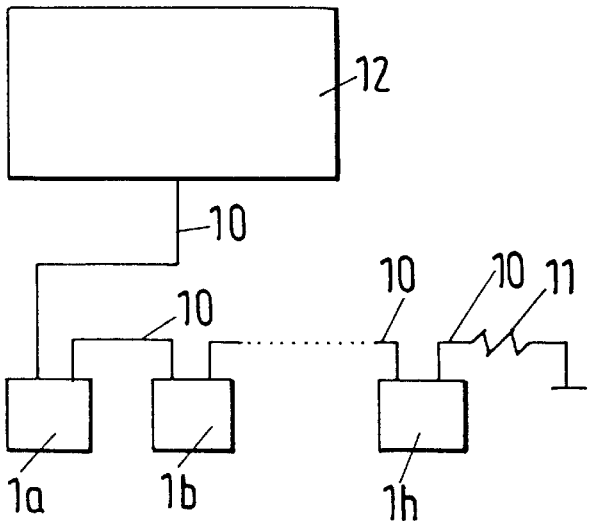
FIG. 2 illustrates, schematically, the controlling of the thread supplying apparatuses.

FIG. 2 shows a plurality of thread supplying apparatuses 1*a*, 1*b*, . . . 1*h*, for example eight thread supplying apparatuses 1, which are connected via a common data bus 10 to the weaving machine control apparatus 12. At the one end the data bus 10 has a terminating resistor 11. A large number of hardware designs for a data bus 10 as well as a large number of software protocols for the transmission of digital data are known to the expert. In the arrangement in accordance with FIG. 2 the CAN protocol (Controller Area Network) format which was developed by Intel and Bosch is used, such as for example is described in the article of L. Fredriksson, 4596 Mechatronics, 4(1994) March, No. 2, Head. Hill Hall, Oxford GB, or is specified in ISO norm 11898.

Figure 5:
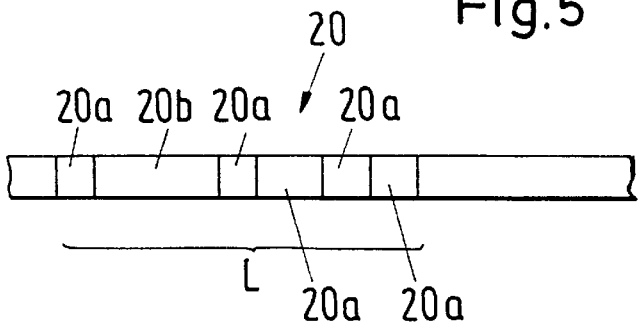
FIG. 5 illustrates, symbolically, the composition of a message type for transmitting digital data.

FIG. 5 shows an example of a data structure in accordance with the CAN protocol which is used for controlling the thread supplying apparatuses 1. The message 20 has a length L and comprises a plurality of frames 20*a* as well as a data part 20*b*. The data part usually comprises 0 to 8 bytes of data, 5 bytes in the exemplary embodiment illustrated in accordance with FIG. 3.

Figure 3:
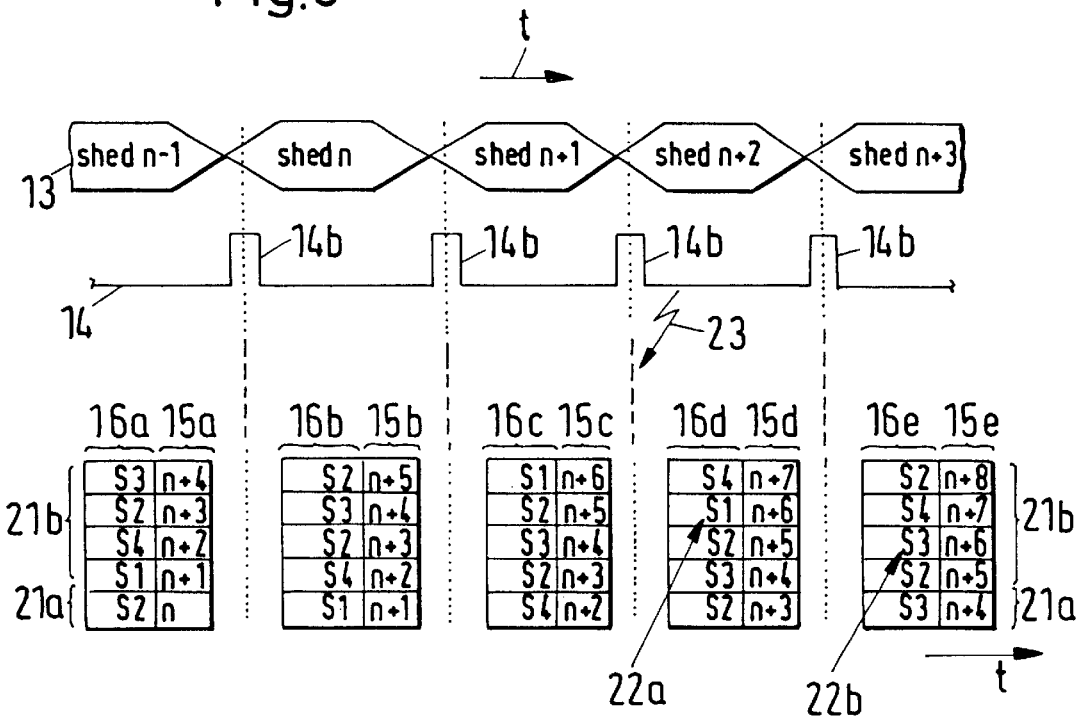
FIG. 3 illustrates the time sequence of the control signals.

In FIG. 3 the temporal sequence of the control signals which are produced by the weaving machine control apparatus 12 is illustrated. The time t is illustrated on the abscissa. The temporal sequence of the shaft movements n of the weaving machine, which successively take place and which serve for the formation of a shed and for the subsequent weft insertion, is illustrated with the signal 13. A non-illustrated sensor which measures the angular position of the crankshaft as an angular trigger signal 14 is arranged at the crankshaft of the weaving machine, with a trigger signal 14*b* being produced after each complete rotation. The angular trigger signal 14 and the trigger signal 14*b* could also be produced electronically, with respect to which signals of all components of the weaving machine are actuated in a synchronized manner. An arrangement of this kind is also designated as an electronic crankshaft. The weaving machine comprises four thread supplying apparatuses 1*a*, 1*b*, 1*c*, 1*d* which supply the weft threads number S1, S2, S3, and S4. The weft threads S1 and S3 have the same color, whereas the further weft threads S2 and S4 have a different color. A table is stored in the weaving machine control apparatus 12 in which the color sequence of the weft threads S1, S2, S3, S4 to be inserted is stored. In the illustrated exemplary embodiment a message 20 is transmitted from the weaving machine control apparatus 12 via the data bus 10 to all four thread supplying apparatuses 1*a*, 1*b*, 1*c*, 1*d*, with the data part 16*a* having a length of 5 bytes, or, respectively, containing the information for the weft thread requirement for the following five weft insertions. The data byte 21*a* contains the information of the weft thread S2 to be inserted into the next shed n. The further four data bytes 21*b* contain the information of four succeeding weft insertions. The gaps 15*a*, 15*b*, 15*c*, 15*d* and 15*e* are illustrated for the sake of clarity and designate the respective shed n which is associated with the weft thread S1, S2, S3, S4 and into which the weft thread S1, S2, S3, S4 is inserted. In the message 20 naturally only the data part 16*a*, but not however the information of the gap 15*a*, is transmitted, since the sequence of the weft threads S1, S2, S3, S4 to be inserted is implicitly known from the sequence of the data bytes. After a complete weaving machine cycle, or, respectively, after the appearance of the trigger signal 14*b*, the next following data part 16*b* is generated by the weaving machine control apparatus and is transmitted to the thread supplying apparatuses 1*a*, 1*b*, 1*c*, 1*d* via the data bus 10. Since all data of the data part 16*b* are located in the same message 20, they are transmitted at the same time. Each thread supplying apparatus 1*a*, 1*b*, 1*c*, 1*d* then has the information of the data part 16*b* available. Thus for example it is known to the thread supplying apparatus 1*b*, which provides the weft thread S2, that weft thread S2 will be drawn off from the storage drum 2 when sheds n+3 and n+5 are open. As a result of this advance information 21*b* the thread supplying apparatus 1*b* can control the wind-up member 6 in such a manner that a sufficient amount of weft thread 3*a* is stored on the storage drum 2 in time, and that this amount of weft thread 3*a* is wound as carefully as possible onto the storage drum 2. The data parts 16*c*, 16*d* and 16*e* show further contents of messages 20 which are transmitted in a manner which is synchronized with respect to the position of the crankshaft.

An advantageous error correction method is likewise explained with reference to the illustration in accordance with FIG. 3. At the time point of the opened shed n+2 the thread supplying apparatus 1*a* determines a breakage of the weft thread S1 and reports this event to the weaving machine control apparatus 12 via the data bus 10 with the help of an interrupt signal 23. Since the thread supplying apparatuses 1*a* and 1*c* have weft threads S1, S3 of the same color stored, the weaving machine control apparatus generates with the next following data part 16*e* a controlling of the thread supplying apparatuses 1*a*, 1*c* which is modified with respect to the data part 16*d* in that at the position N+6 the weft thread S1 is no longer drawn off from the thread supplying apparatus 1*a*, as is designated by 22*a*, but rather the weft thread S3 is drawn off from the thread supplying apparatus 1*c*, as is designated by 22*b*. Since the information which is designated by 22*b* lies in the area of the advance information, the thread supplying apparatus 1*c* has enough time available in order to provide the required weft thread requirement.

Figure 4:
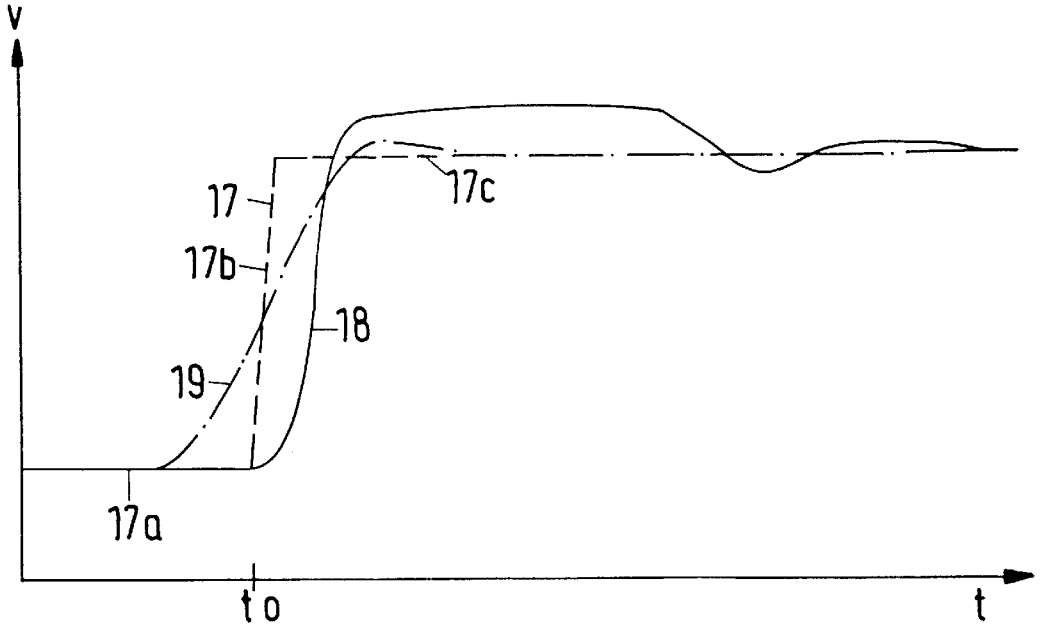
FIG. 4 is a speed-time diagram of the thread requirement of a thread supplying apparatus.

FIG. 4 shows the plot of the draw-off speed 17 as well as the wind-up speed 19 of a weft thread S1 at the storage drum 2 of the thread supplying apparatus 1*a*. An amount of weft thread 3*a* is stored on the storage drum 2 of the thread supplying apparatus 1*a* which is sufficient for at least two complete weft insertions. Up to the time point to the weft thread S1, which can be drawn off, is stationary and the weft thread draw-off speed thus amounts to 0 m/s. Starting at the time point to the weft thread S1 is drawn off from the storage drum 2, with the weft thread S1 experiencing an acceleration 17*b* and then being drawn off with constant draw-off speed 17*c*. In this situation the thread supplying apparatus 1*a* would replenish the weft thread S1 with a supply speed corresponding to the curve plot 18 without advance information in that the wind-up member 6 is strongly accelerated after the time point to in order to refill the weft thread supply on the storage drum 2 through weft threads which are replenished. In this it is necessary that the supply speed, as can be seen in the curve plot 18, lies above the draw-off speed 17*c* during a certain period of time in order to replenish the amount of weft thread S1 which was drawn off from the storage drum 2. The method in accordance with the invention enables, as can be seen from the plot of the curve 19 representing the weft thread supply speed, a substantially more careful supply of the weft thread S1. Thanks to the advance information which is available to the thread supplying apparatus 1*a* the wind-up member 6 already begins to rotate prior to the time point to so that the weft thread S1 is wound up onto the storage drum 2. At the time point to a specific amount of weft thread S1 has already been supplied, so that, as can be seen in FIG. 4, the curve 19 requires a substantially lower slope than the curve 18, and in addition the curve 19 has only a slight overshoot. As a result of the information 16*a*, 16*b*, 16*c*, 16*d*, 16*e* which is available the thread supplying apparatus 1*a* is in the position to control the speed of rotation of the wind-up member 6 in such a manner that the acceleration of the weft thread S1 remains as low as possible and/or that the wind-up speed remains as low as possible.

Figure 6:
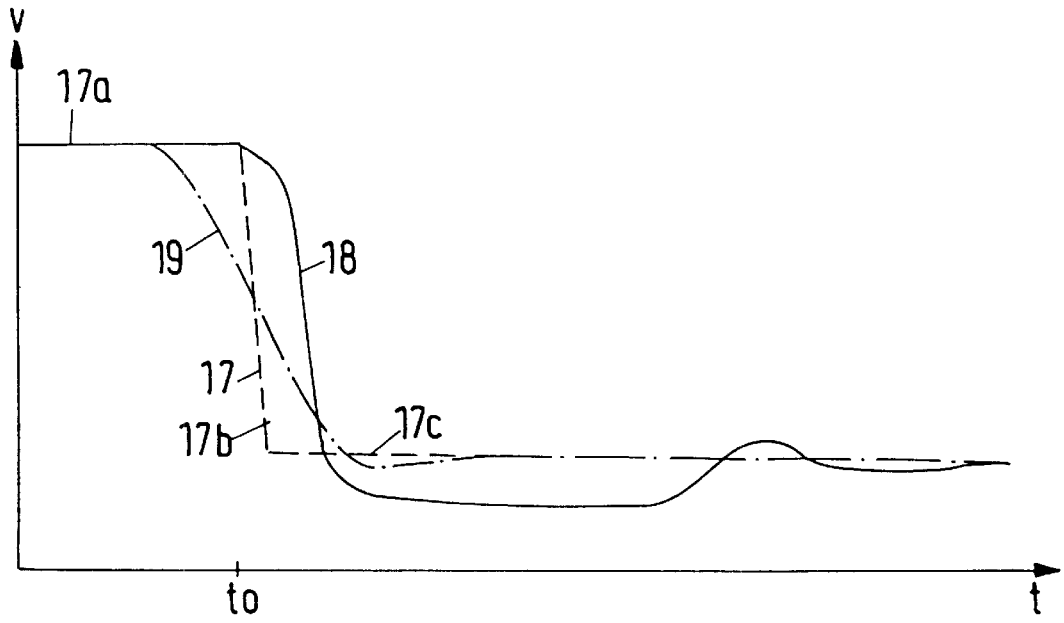
FIG. 6 is a speed-time diagram at reduced thread requirement of a thread supplying apparatus.

In the illustration in accordance with FIG. 4 the weft thread S1 could already be drawn off prior to the time point to, therefore in the curve section 17*a*, with a draw-off speed of for example 5 m/s. At the time point to the weft thread S1 would be drawn off with a higher draw-off speed 17*c*. In this case as well the thread supplying apparatus 1*a* would control the wind-up member 6, thanks to the available advance information, in such a manner that the weft thread S1 is supplied to the storage drum in accordance with the plot of the curve 19 in a manner which protects the yarn. A weft thread draw-off behavior of this kind arises for example when, as illustrated in FIG. 3, the thread supplying apparatus 1*a* fails and the thread requirement must then be supplied by the thread supplying apparatus 1*c*, which doubles the weft thread draw-off speed at the thread supplying apparatus 1*c*. As soon as the thread supplying apparatus 1*a* is again put into operation the weft thread draw-off speed 17 is reduced in a stepwise manner, as is illustrated in FIG. 6, in that the initially higher weft thread speed 17*a* is reduced to the weft thread speed 17*c* at the time point to. In this situation as well the wind-up member 6 of the thread supplying apparatus 1*a* is controlled with the use of the available advance information in such a manner that a weft thread supply speed in accordance with the curve plot 19 takes place, which acts on the weft thread S1 in a manner which protects the yarn. In particular, when a weaving machine is operated in accordance with the mix-change principle, i.e. when similar weft threads S1, S2 are drawn off alternatingly from at least two thread supplying apparatuses 1*a*, 1*b*, the advantage results, with the method in accordance with the invention for operating the thread supplying apparatuses 1*a*, 1*b*, that, in the event of a failure of a thread supplying apparatus 1*a*, 1*b*, the weaving operation can be continued through the thread supplying apparatuses 1*a*, 1*b* which are still capable of functioning.

Figure 7:
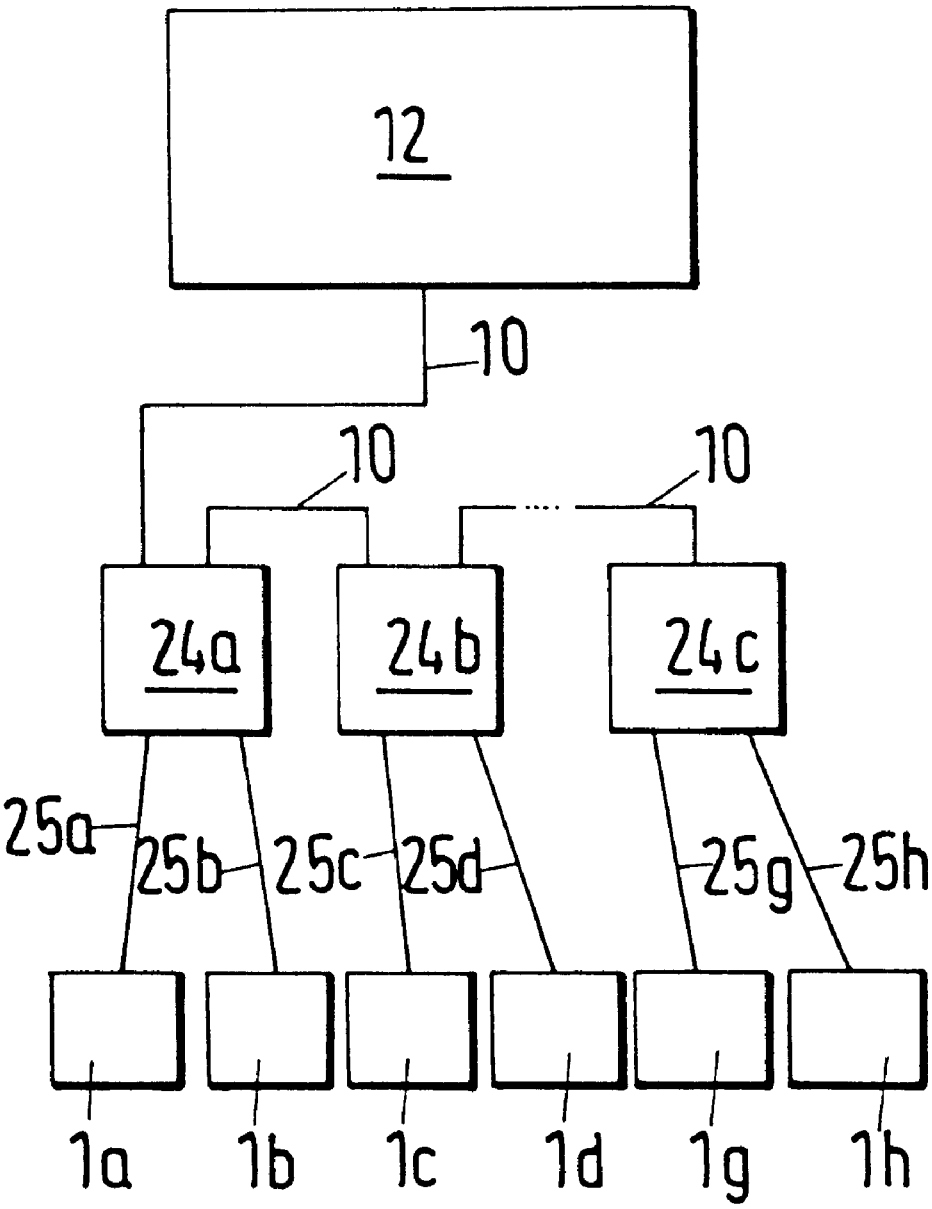
FIG. 7 is a further arrangement for controlling the thread supplying apparatuses.

In FIG. 7 a further arrangement of the weaving machine control apparatus 12 and the thread supplying apparatuses 1*a*, 1*b*, 1*c*, 1*d*, 1*g*, 1*h* is illustrated. In this arrangement the data bus 10 is connected to control devices 24*a*, 24*b*, 24*d* starting from the weaving machine control apparatus 12. The thread supplying apparatuses 1*a*, 1*b*, 1*c*, 1*d*, 1*g*, 1*h* are in each case connected pairwise to one control device 24*a*, 24*b*, 24*d* via electrical lines 25*a*, 25*b*, 25*c*, 25*d*, 25*g*, 25*h*. The control device 24*a*, 24*b*, 24*d* processes the information which is made available on the data bus 10 and calculates in addition the respective advantageous speed of rotation of the respective wind-up member 6, in particular its acceleration and its braking respectively. The arrangement which is illustrated in FIG. 7 has the advantage that the thread supplying apparatuses 1*a*, 1*b*, 1*c*, 1*d*, 1*g*, 1*h* can be designed very simply with respect to the control electronics. In addition, older thread supplying apparatuses 1*a*, 1*b*, 1*c*, 1*d*, 1*g*, 1*h* can also be operated with the method in accordance with the invention.

What is claimed is:

1. A method for the operation of a thread supplying apparatus of a weaving machine in order to feed a weft thread to the weaving machine, the method comprising transmitting information about a required weft thread for at least two subsequent weft insertions, the information being transmitted after every complete weaving machine cycle to the thread supplying apparatus and at the same time, whereby the information about the required weft thread of at least one of the at least two subsequent weft insertions has already previously been transmitted.

2. A method in accordance with claim 1 wherein the information is transmitted to a plurality of thread supplying apparatuses.

3. A method in accordance with claim 2 wherein in the event of a failure of a thread supplying apparatus, remaining thread supplying apparatuses are controlled in such a manner that the information that is required for producing a cloth is provided by the remaining thread supplying apparatuses.

4. A method in accordance with claim 1 wherein the information is about a required weft thread for more than two subsequent weft insertions.

5. A method in accordance with claim 1 wherein the thread supplying apparatus comprises a wind-up member winding up the weft thread onto a storage drum; and wherein the wind-up member is controlled as a result of the information with a speed of rotation that is such that during preparation of the information, at least one of the speed of rotation of the wind-up member remains low and the respective acceleration and braking of the wind-up member takes place slowly.

6. A method in accordance with claim 4 wherein the information is for four subsequent weft insertions.

7. A method in accordance with claim 4 wherein the information is for eight subsequent weft insertions.

8. A method in accordance with claim 4 wherein the information is about a required weft thread for twelve subsequent weft insertions.

9. A method in accordance with claim 4 wherein the information is about a required weft thread for sixteen subsequent weft insertions.

* * * * *